US006817261B2

(12) United States Patent
Mototani et al.

(10) Patent No.: US 6,817,261 B2
(45) Date of Patent: Nov. 16, 2004

(54) MONOLEVER DEVICE

(75) Inventors: Masayoshi Mototani, Oyama (JP); Shuuji Hori, Oyama (JP)

(73) Assignee: Komatsu Ltd., Tokyo (JP)

( * ) Notice: Subject to any disclaimer, the term of this patent is extended or adjusted under 35 U.S.C. 154(b) by 19 days.

(21) Appl. No.: 10/157,998

(22) Filed: May 31, 2002

(65) Prior Publication Data

US 2003/0000327 A1 Jan. 2, 2003

(30) Foreign Application Priority Data

Jun. 22, 2001 (JP) ..... 2001-190507

(51) Int. Cl.[7] ..... G05G 5/04
(52) U.S. Cl. ..... 74/471 XY; 200/6 A
(58) Field of Search ..... 74/471 XY; 192/138; 200/64, 334, 335, 339; 338/128

(56) References Cited

U.S. PATENT DOCUMENTS 3,918,496 A * 11/1975 Byers, Jr. ..... 74/471 XY
5,184,646 A * 2/1993 Hori et al. ..... 74/471 XY
5,831,554 A * 11/1998 Hedayat et al. ..... 74/471 XY
5,857,492 A * 1/1999 Salamun ..... 74/471 R
5,935,352 A * 8/1999 Andersson ..... 148/575

FOREIGN PATENT DOCUMENTS

JP 7-49167 11/1995
JP 9-89515 4/1997

* cited by examiner

*Primary Examiner*—David A. Bucci
*Assistant Examiner*—Timothy McAnulty
(74) *Attorney, Agent, or Firm*—Varndell & Varndell, PLLC

(57) ABSTRACT

A monolever operating device that inclines in a two-dimensional manner including at least a front and rear direction and a right and left direction. A drive signal generating unit contained within a drive signal generating body for outputting two drive signals to components in the front and rear direction and in the right and left direction in accordance with an orientation and an amount of inclination of the monolever. The device further includes a universal joint mounted to support the monolever in an inclinable manner, a mount plate for mounting the drive signal generating body mounted thereto to a vehicle body, and a monolever bearing member provided on an upper surface of the mount plate and provided with lever bearing portions and boot holding portions alternately arranged adjacent to each other in a circumferential direction.

19 Claims, 7 Drawing Sheets

MONOLEVER DEVICE

BACKGROUND OF THE INVENTION

1. Field of the Invention

The invention relates to a monolever operating device, and more particularly, to a monolever operating device, which is excellent in abrasion resistance, good in durability and high in reliability and can be conformed to many kinds of machines.

2. Description of the Related Art

Inventions have been already known relating to an operating lever device, in which a single operating lever (referred below to as a "monolever") is operatively inclined to generate an operating signal and two hydraulic actuators are drivingly controlled on the basis of the operating signal. For example, Japanese Patent Laid-Open No. 89515/1997 discloses an electrical type operating lever device, in which a monolever is operatively inclined to have each of four pistons issuing an electric signal representative of its displacement. Two hydraulic actuators can be drivingly controlled on the basis of an electric signal issued from the electrical type operating lever device.

Also, Japanese Utility Model Publication No. 49167/1995 discloses a hydraulic type operating lever device 60 which outputs a hydraulic signal. In this publication, the hydraulic type operating lever device 60 comprises a hydraulic body 63 having four pistons 62, which are pressed upon inclination of a monolever 61 in a front and rear direction and in a right and left direction, and of which respective displacements are output as hydraulic signals, on the basis of which two hydraulic actuators can be drivingly controlled.

With the hydraulic body 63, four pistons 62*a*, 62*b*, 62*c*, 62*d* (shown in FIG. 2), which constitute a piston 62, are arranged in equidistant positions on a circumference in a manner to abut against a disk plate 64 mounted on the monolever 61. The four pistons 62*a*, 62*b*, 62*c*, 62*d* are pushed and displaced by the disk plate 64 in accordance with an orientation and an amount of inclination of the monolever 61.

Hydraulic pressure generating means Hd for generating a hydraulic signal of a magnitude corresponding to respective displacements of the pistons 62*a*, 62*b*, 62*c*, 62*d* are provided on the hydraulic body 63. In addition, the hydraulic body 63 comprises a drive signal generating body and the hydraulic pressure generating means Hd comprise a drive signal generating means.

The monolever 61 is mounted to the hydraulic body 63 through a universal joint 65. The hydraulic body 63 is mounted on a mount plate 66 shown in FIGS. 7(*a*) and 7(*b*) and on a vehicle body 68 near a driver seat by means of bolts 67 extending through vehicle body bolt holes 66*a* formed in the mount plate 66.

In FIGS. 7(*a*) and 7(*b*), the mount plate 66 is provided with a ring-shaped stopper projection 69, which in turn is provided with arcuate-shaped projections 69*a* adapted to abut against the disk plate 64 to restrict an inclination θ of the monolever 61. The mount plate 66 is provided with an annular groove 69*b* on an outer periphery of the ring-shaped stopper projection 69. One end of a boot 70 covering the four pistons 62 is inserted into the annular groove 69*b*. Also, the other end of the boot 70 is inserted into an annular groove 71*a* provided on an outer periphery of a coupling 71, which connects the universal joint 65 and the monolever 61 to each other as shown in FIG. 6.

In recent years, the operating lever device constituted in the above manner has been improved in operability and made small in size to be used in many construction machines and industrial machinery such as small-sized and large-sized hydraulic shovels, bulldozers, rough terrain cranes and so on.

With the above constitution, Japanese Utility Model Publication No. 49167/1995 proposes the provision of a single mount plate for parts to improve an increase in cost, caused by an increased number of parts due to the fact that a part for mounting of a boot is separate from a mount plate.

However, since the operating lever device has been used in many construction machines and industrial machinery in recent years as described above, the mount plate shown in FIGS. 7(*a*) and 7(*b*) differ in configuration and dimension of inclination every machine, and so manufacture of the single mount plate necessitates a new metallic mold to lead to an increase in cost of parts and a large amount of expense in manufacture of a metallic mold.

For example, the mount plate is fabricated from a sintered material to shape the projection for stoppage and the arcuate projection in order to facilitate manufacture and realize cost reduction. There is caused a problem that a metallic mold for manufacture of the sintered material is increased in manufacture cost since an annular groove is provided on a side of the mount plate and manhour in assembling is increased at the time of manufacture.

Also, since the mount plate is fabricated from a sintered material, the projection for stoppage and adapted to abut against the disk plate is worn. Such wear causes a problem that the operating lever device becomes hard to operate because an operating lever is increased in stroke after use over a long term.

When the projection for stoppage is further increased in thickness in order to prevent the wear, there is caused a problem that the operating lever device becomes large and so difficult in use for small-sized construction machines or a major part of the device must be made large to impose a limitation on a driver seat. Also, a part for mounting of a boot and a mount plate are conventionally separate from each other, and so there is caused a problem that the boot is worsened in assembling property and cost is increased since the part does not function as a bearing portion for inclination of the operating lever and so other part is needed.

SUMMARY OF THE INVENTION

The invention has been thought of in view of the above problems, relates to a monolever operating device and has its object to provide a monolever operating device, which is favorable in assembling property and susceptible of less wear and can be made small in size and inexpensively conformed to many kinds of machines.

In order to attain the above objects, a monolever operating device according to the invention comprises a monolever capable of inclining in a two-dimensional optional direction conformed to at least a front and rear direction and a right and left direction, drive signal generating means received in a drive signal generating body to output two drive signals to components in the front and rear direction and in the right and left direction in accordance with an orientation and an amount of inclination of the monolever, a universal joint mounted on the drive signal generating body to support the monolever in an inclinable manner, a mount plate for mounting the drive signal generating body mounted thereto to a vehicle body, a boot provided between the monolever and the mount plate to cover the drive signal generating means, and a monolever bearing member provided on an upper surface of the mount plate and provided with lever bearing portions and boot holding portions alternately arranged adjacent to each other in a circumferential direction.

In this case, the monolever bearing member comprises a press formed part of a low-carbon steel material subjected to carburization.

Also, the monolever bearing member may comprise lever bearing portions provided perpendicular to a surface thereof being mounted on the mount plate and boot holding portions provided in parallel to the surface to hole the boot.

Also, slits may be provided between the lever bearing portions and the boot holding portions of the monolever bearing member.

Also, the lever bearing portions of the monolever bearing member may be formed to be arcuate Ra as viewed in plan view.

With the above constitution, the monolever operating device comprises a mount plate for mounting the drive signal generating body to a vehicle body and a monolever stopping member for stopping an inclination of the monolever, and the arrangement is alternate on a circumference, whereby insertion of the boot into the monolever stopping member is facilitated and assembling is made easy to achieve reduction in manhour in assembling.

Also, the monolever stopping member is made a single part whereby the monolever stopping member having a plurality of configurations can be subjected to drawing in one step to reduce cost for a metallic mold. Also, the monolever stopping member is made a single part whereby a monolever operating device capable of conforming to many kinds of machines can be provided by preparing a plurality of monolever stopping members having different sizes.

The monolever bearing member is formed from a low-carbon steel material subjected to carburization to be increased in hardness, so that the lever bearing portions are reduced in wear, by which the performance can be prevented from changing after use over a long term. Also, fabrication is made by means of press work to thereby achieve reduction in manhour in work.

The monolever bearing member is composed of the lever bearing portions and the boot holding portions, so that a demand for a design value with a different inclination can be accommodated for by modifying a length of a sheet material for the lever bearing portions. Also, even when a length of the lever bearing portions is modified at the time of press work, a metallic mold can be readily manufactured to reduce cost for manufacture of the mold and facilitate management of the mold.

With the monolever bearing member, the slits are provided between the lever bearing portions and the boot holding portions of the monolever bearing member, whereby the lever bearing portions and the boot holding portions can be arranged alternately adjacent to each other in a circumferential direction, and press work can be performed with ease. At this time, the slits are extended inward from bent portions to thereby facilitate drawing.

The lever bearing portions of the monolever bearing member are formed to be arcuate as viewed in plan view, so that the lever bearing portions are made high in allowable bending stress and so can be made thin to achieve miniaturization.

As described above, the monolever bearing member is structured such that the lever bearing portions and the boot holding portions are arranged alternately adjacent to each other in a circumferential direction with the slits therebetween, a low-carbon steel material is subjected to carburization for an increased hardness, and the lever bearing portions are formed to be arcuate. Thereby, even when being made small in plate thickness, the monolever bearing member is enhanced in abrasion resistance and allowable bending stress, mounting of the boot is facilitated, the same metallic mold complies with a demand for a variety of inclinations, and press work is enabled, whereby work and assembling are facilitated, miniaturization is achieved, and a change in performance after use over a long term can be decreased.

DETAILED DESCRIPTION OF THE PREFERRED EMBODIMENT

Figure 1:
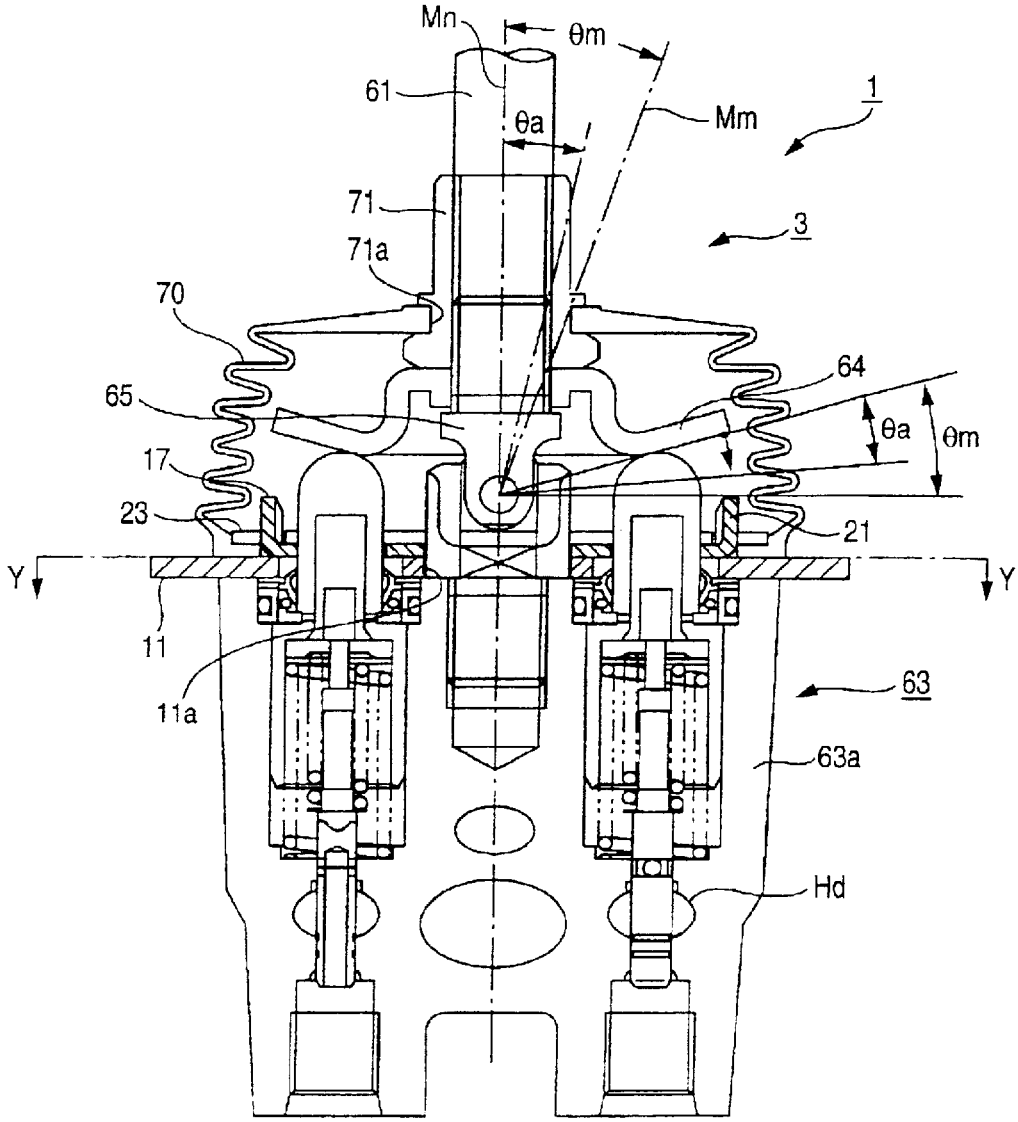
FIG. 1 is a side cross sectional view of a hydraulic monolever operating device according to an embodiment of the invention.

An embodiment of a monolever operating device according to the invention will be described below with reference to the drawings. In addition, the same reference numerals denote the same parts as those in the prior art.

First, a monolever operating device according to the embodiment will be described with reference to FIGS. 1 to 5(*b*). FIG. 1 is a side cross sectional view of a hydraulic monolever operating device 1 according to the embodiment, FIG. 2 being a general plan view of the device shown in FIG. 1, FIG. 3 being a cross sectional view taken along the plane Y—Y in FIG. 1, FIGS. 4(*a*) and 4(*b*) being a part drawing of a monolever bearing member, and FIGS. 5(*a*) and 5(*b*) being a part drawing of the monolever bearing member.

Figure 2:
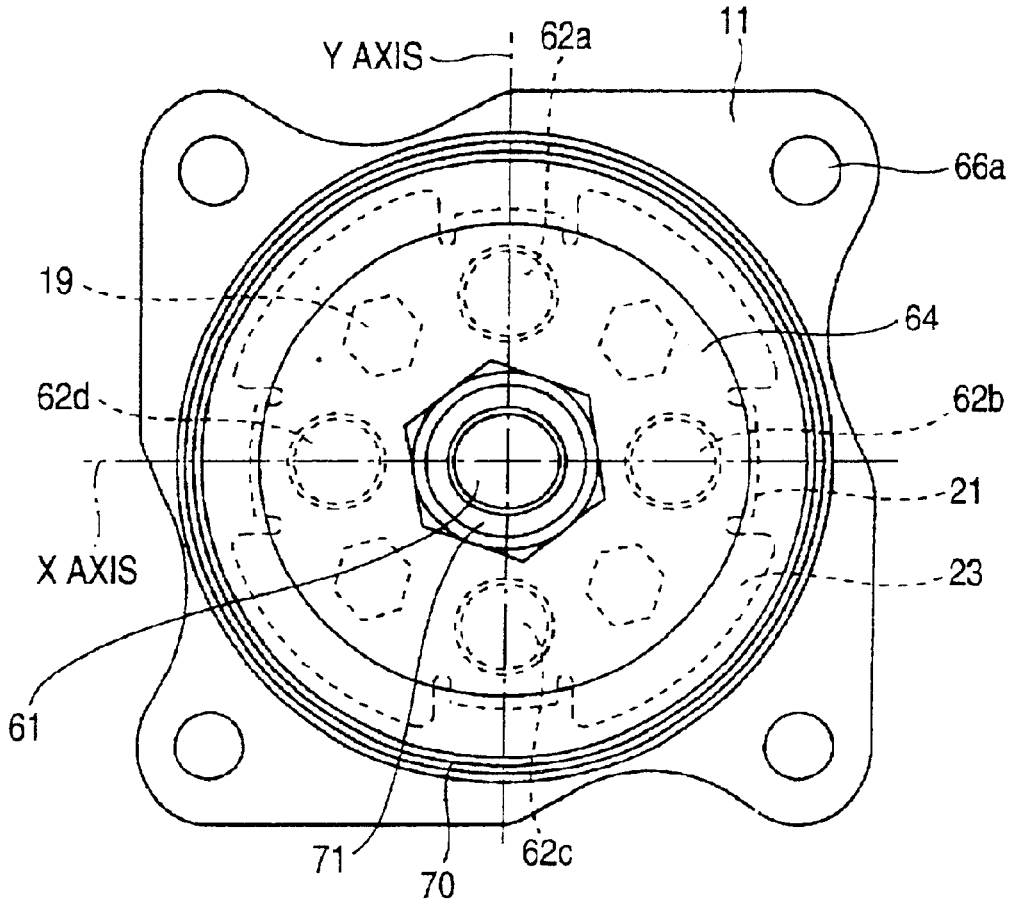
FIG. 2 is a general plan view of the hydraulic monolever operating device according to the embodiment of the invention.
Figure 3:
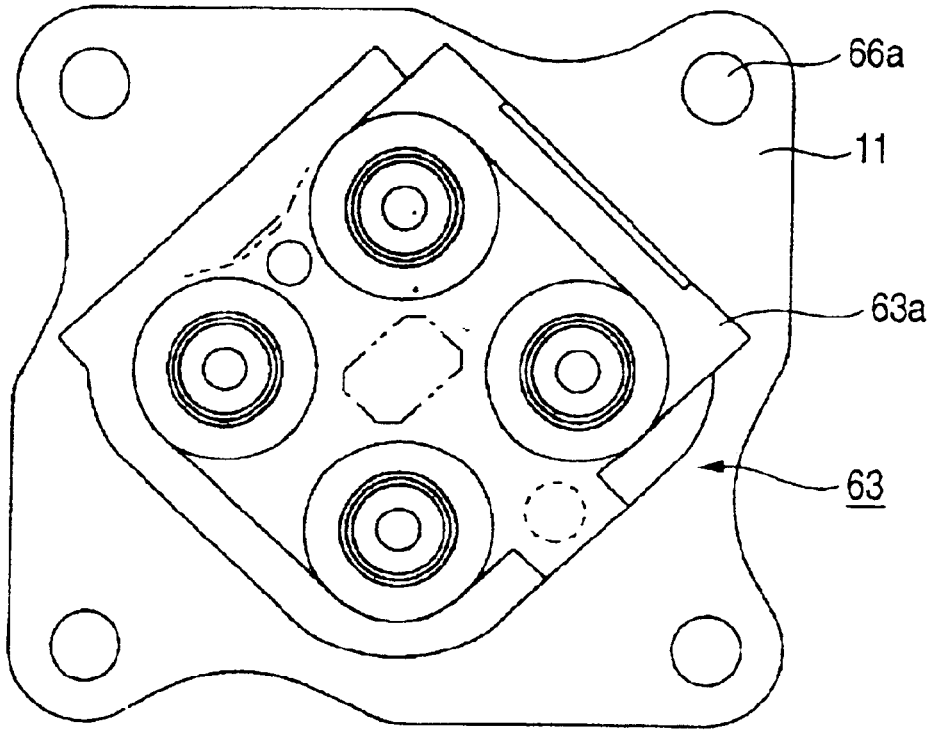
FIG. 3 is a cross sectional view taken along the plane Y—Y in FIG. 1.

In FIGS. 1 and 2, a hydraulic monolever operating device 1 is composed of a monolever section 3 capable of inclining in a front and rear direction, and in a right and left direction, and a hydraulic body 63 for outputting displacements of four pistons as a hydraulic signal every piston upon inclination of the monolever section 3. The monolever section 3 extends through a universal joint hole 11*a* provided in a mount plate 11 for the hydraulic body 63 to be mounted to a valve body 63*a* of the hydraulic body 63.

Also, a disk plate 64 is mounted on the monolever section 3 as shown in FIG. 2 in a manner to abut against tip ends (upper ends) of four pistons 62*a*, 62*b*, 62*c*, 62*d* sealingly inserted into the hydraulic body 63. The disk plate 64 is mounted to a lower end of a monolever 61 to push the pistons 62*a*, 62*b*, 62*c*, 62*d* in accordance with an orientation and an amount of inclination of the monolever 61 in the front and rear direction (for example, Y-axis direction) and the right and left direction (for example, X-axis direction).

The pistons 62*a*, 62*b*, 62*c*, 62*d* are pushed by the disk plate 64 in accordance with an orientation and an amount of inclination of the monolever 61 of the monolever section 3 to undergo displacement, by which hydraulic pressure generating means Hd for generating a hydraulic signal of a magnitude corresponding to respective displacements of the pistons 62*a*, 62*b*, 62*c*, 62*d* are provided on the hydraulic body 63. More specifically, the hydraulic pressure generating means Hd generate hydraulic signals of magnitudes corresponding to displacements, which the pistons 62*a*, 62*b*, 62*c*, 62*d* are pushed, in accordance with an orientation and an amount of inclination of the monolever 61 in the front and rear direction and in the right and left direction.

In FIGS. 1 and 2, the monolever 61 of the monolever section 3 is connected to a universal joint 65 by a coupling 71 and supported by the universal joint 65 to be able to incline in the front and rear direction and in the right and left direction. The universal joint 65 extends through the universal joint hole 11*a* provided in the mount plate 11 to be mounted to the valve body 63*a* of the hydraulic body 63.

When the monolever 61 is turned (turned in an oblique direction) in the front and rear direction and in the right and left direction, the universal joint 65 causes the disk plate 64 to be inclined to push the respective pistons 62*a*, 62*b*, 62*c*, 62*d*, whereupon hydraulic pressures conformed to components of displacements in the front and rear direction and in the right and left direction are output by the hydraulic pressure generating means Hd.

In FIG. 1, the monolever section 3 comprises a monolever bearing member 17 adapted to abut against the disk plate 64 mounted to the monolever 61 to restrict a maximum inclination θm of the monolever 61, a portion of the monolever bearing member 17 being disposed outside the four pistons 62*a*, 62*b*, 62*c*, 62*d*. The monolever bearing member 17 is arranged on an upper surface of the mount plate 11 and mounted by means of bolts 19 to the valve body 63*a* of the hydraulic body 63 through the mount plate 11.

Figure 4:
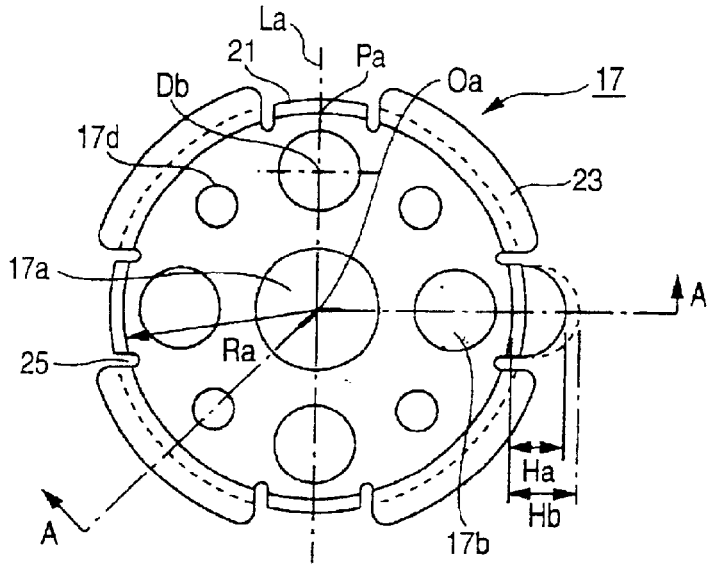
FIGS. 4(*a*) and 4(*b*) are a part drawing of a monolever bearing member in the hydraulic monolever operating device according to the embodiment of the invention, A being a plan view, and B being a cross sectional view taken along the line A-Oa-A in A.
Figure 4:
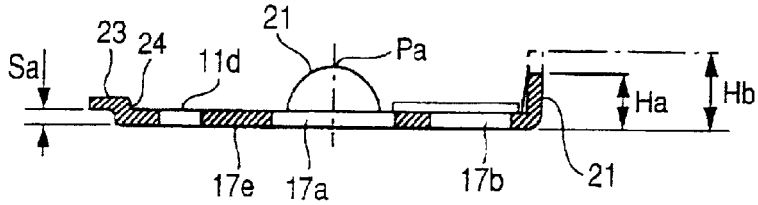

In FIGS. 4(*a*) and 4(*b*), formed in the monolever bearing member 17 are a universal joint hole 17*a* disposed centrally of the member and having the universal joint 65 extending therethrough, piston holes 17*b* disposed around the universal joint hole and having the pistons 62*a*, 62*b*, 62*c*, 62*d* extending therethrough, and bolt holes 17*d* disposed between the four piston holes 17*b*, which have the pistons 62*a*, 62*b*, 62*c*, 62*d* extending therethrough, and having the bolts 19 extending therethrough.

The monolever bearing member 17 comprises lever bearing portions 21 and boot holding portions 23, which are alternately arranged on a circumference outside of the piston holes 17*b* and bolt holes 17*d*. Provided on the monolever bearing member 17 are the lever bearing portions 21 provided perpendicular to a bottom surface 17*e* adapted to abut against the mount plate 11, and the parallel boot holding portions 23 having a gap Sa for insertion of a boot thereinto and a surface parallel to the bottom surface 17*e*.

The lever bearing portions 21 are formed to be semi-circular in shape and provided so that peaks Pa of the semi-circular projections are positioned on respective lines La connecting a central point Oa and central points Ob of the four pistons 62*a*, 62*b*, 62*c*, 62*d*, the peaks Pa abutting against the disk plate 64.

The monolever bearing member 17 comprises slits 25 between the lever bearing portions 21 and the boot holding portions 23. The slits 25 are formed inward from an outer periphery of the monolever bearing member 17 to be cut inwardly of the lever bearing portions 21 and bent portions 24 of the boot holding portions 23. Thereby, drawing by means of a press or the like is made easy.

Also, the lever bearing portions 21 are formed to be arcuate Ra as viewed in plan view, and so enhanced in allowable bending stress and rigidity, which enables reducing a plate thickness.

In the case where the monolever bearing members 17 are in large quantity, a sheet material is punched by means of press work and then the semi-produce is subjected to drawing by means of a metallic mold to be finished into a configuration shown in FIGS. 4(*a*) and 4(*b*). Also, in the case of small quantity or a special specification involving different inclinations (Hb relative to Ha), a sheet material is subjected to, for example, fine plasma work to be formed with an external shape, the universal joint hole 17*a*, piston holes 17*b* and the bolt holes 17*d*, and then subjected to drawing by means of the metallic mold as that described above.

The boot holding portions 23 are pressed by an upper half of the metallic mold but the lever bearing portions 21 are not pressed from above, so that work can be readily made for an optional height of the bearing portions. Accordingly, a length of a sheet material for the lever bearing portions 21 is made a height for a maximum inclination corresponding to a design value of a desired maximum inclination and thereby drawing can be readily performed with the same metallic mold. Thus different heights Hb of the lever bearing portions 21 can be obtained with the same metallic mold, which reduces cost for metallic molds.

After being formed into the configuration shown in FIGS. 4(*a*) and 4(*b*), the monolever bearing member 17 is subjected to heat treatment to be increased in hardness and enhanced in abrasion resistance. Thereby, even when the lever bearing portions 21 of the monolever bearing member 17 abut against the disk plate 64, they undergo less wear.

It is desired that the monolever bearing member 17 is composed of a formed part obtained by subjecting a low-carbon steel material to press work and then to carburization, which is inexpensive.

Figure 5:
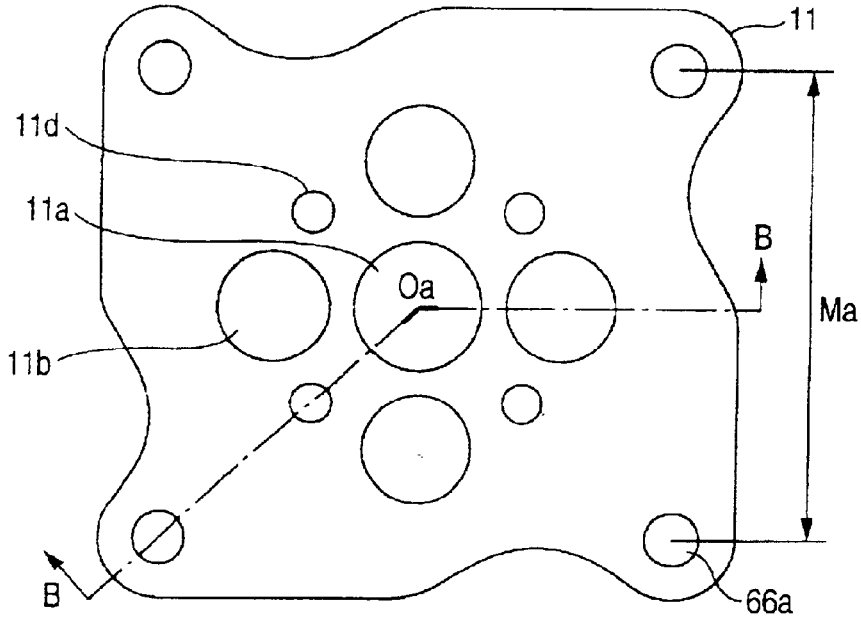
FIGS. 5(*a*) and 5(*b*) are a part drawing of a mount plate in the hydraulic monolever operating device according to the embodiment of the invention, A being a plan view, and B being a cross sectional view taken along the line B-Oa-B in A.
Figure 5:
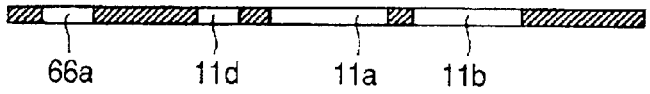
Figure 6:
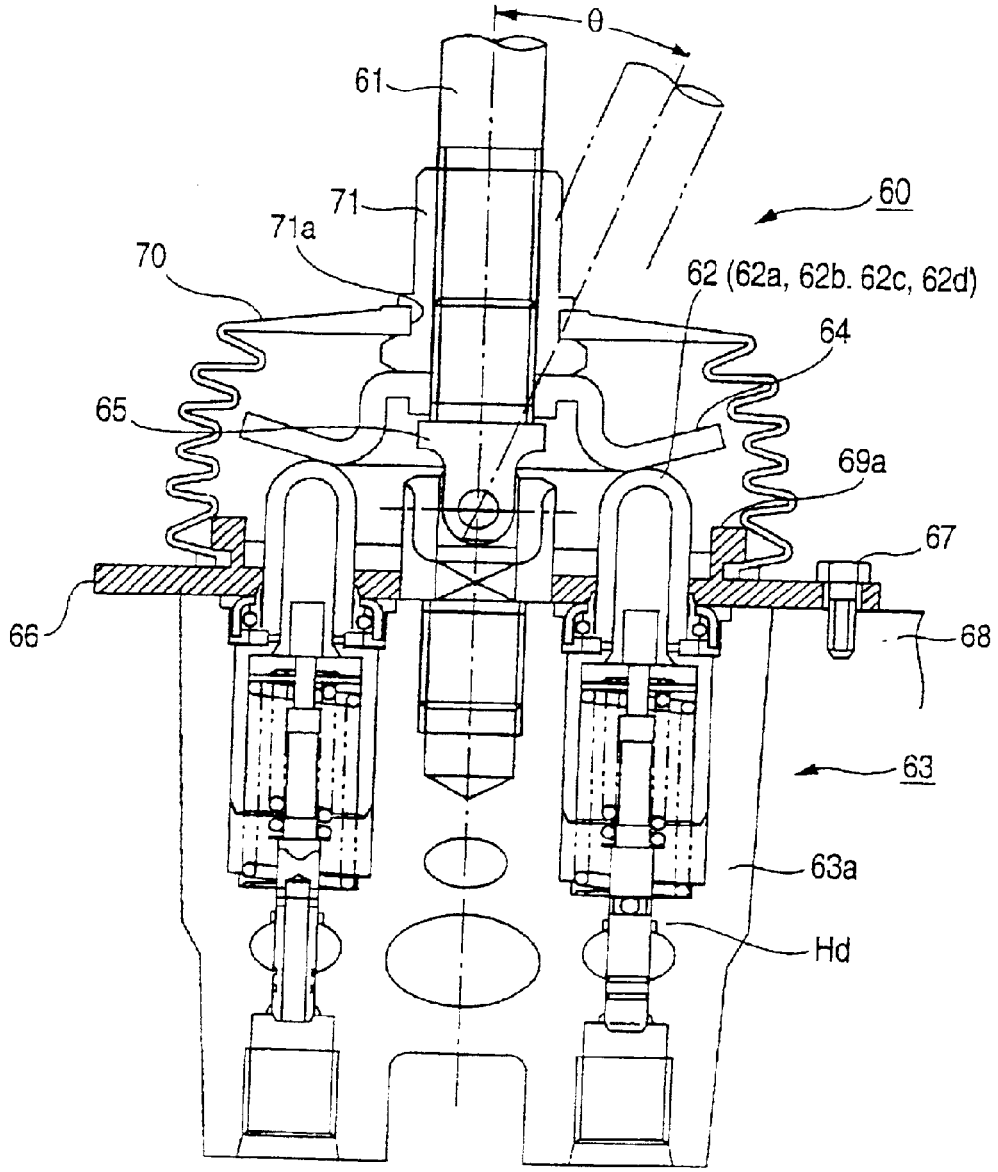
FIG. 6 PRIOR ART
FIG. 6 is a side cross sectional view of a prior hydraulic monolever operating device.
Figure 7:
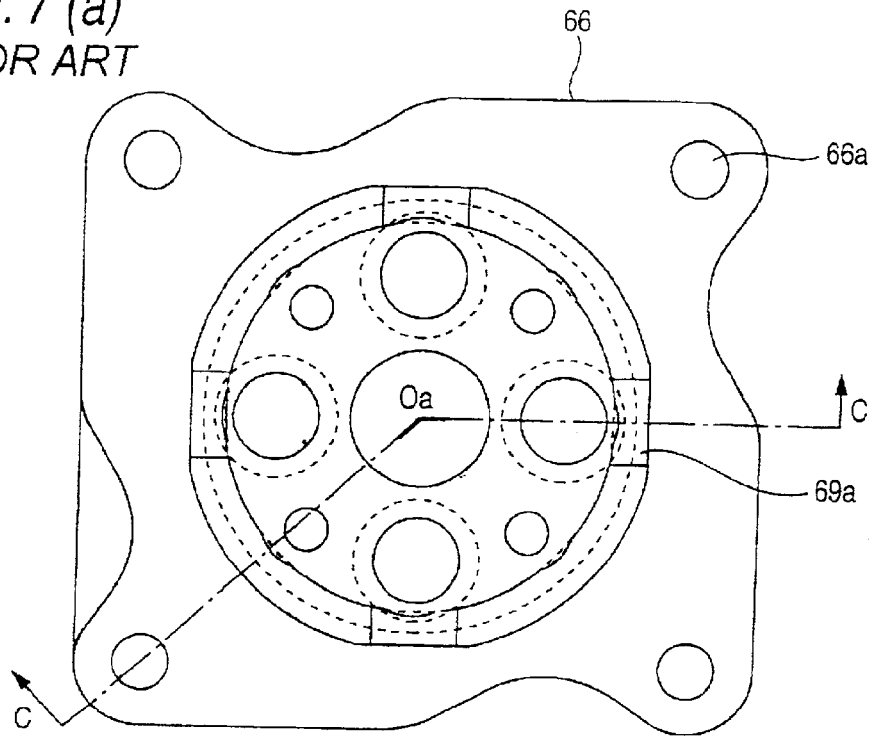
FIG. 7 (a) PRIOR ART
FIGS. 7(*a*) and 7(*b*) are a part drawing of a mount plate in a prior hydraulic monolever operating device, A being a plan view, and B being a cross sectional view taken along the line C-Oa-C in A.
Figure 7:
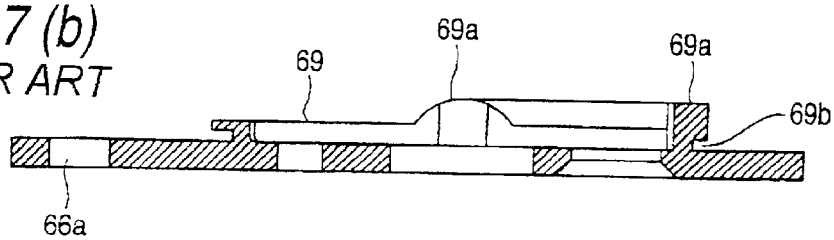
FIG. 7 (b) PRIOR ART

As shown by way of example in FIGS. 5(*a*) and 5(*b*), the mount plate 11 is formed with an external shape conformed to a type of machine, and a pitch Ma of the holes for bolts, which are suited to and mounted to a vehicle body, is determined While the external shape and the pitch Ma of the bolt holes, respectively, are determined depending upon a vehicle or a type of machine, they can be readily conformed to a desired mount plate 11 because a sheet material is subjected to cutting work as it is.

Formed in the mount plate 11 are the universal joint hole 11*a*, piston holes 11*b* and bolt holes 11*d*, which are disposed in the same positions as those of the universal joint hole 17*a*, piston holes 17*b* and the bolt holes 17*d* formed in the monolever bearing member 17. Also, the mount plate 11 is formed with holes 66*a* for bolts for a vehicle body mounted to the vehicle body 68.

The mount plate 11 is formed from an inexpensive sheet material such as common steel or low-carbon steel, and obtained by using press work to punch a sheet material in the case of large quantity. Also, in the case of small quantity, a sheet material is subjected to, for example, fine plasma work to be formed with an external shape, the universal joint hole 11*a*, piston holes 11*b* and the bolt holes 11*d*.

The mount plate 11 is placed on an upper surface of the valve body 63*a* of the hydraulic body 63, and then the monolever bearing member 17 is overlapped and laid on the mount plate and mounted to the valve body 63*a* of the hydraulic body 63 by means of bolts 19. At this time, tip ends of the four pistons 62*a*, 62*b*, 62*c*, 62*d* project above the upper surfaces of the lever bearing portions 21 of the monolever bearing member 17.

Subsequently, the universal joint 65 is mounted on the valve body 63*a* of the hydraulic body 63. The disk plate 64 is threaded onto the universal joint 65 while being adjusted in a manner to come into contact with tip ends of the four pistons 62*a*, 62*b*, 62*c*, 62*d*. Further, the monolever 61 is connected to the universal joint 65 and the coupling 71, to which a boot 70 is latched, is threaded onto the universal joint 65.

The boot 70 is placed on the hydraulic body 63 with a lower end thereof receiving therein the coupling 71 and the universal joint 65. Subsequently, an entire surface of a lower portion of the boot 70 is pushed into the gap Sa after the lower portion is inserted from the boot holding portions 23 of the monolever bearing member 17. At this time, the boot 70 is easily inserted into a first one of the boot holding portions 23 since the lever bearing portions 21 on both sides of the first one is provided in a withdrawn manner. When the boot 70 is inserted into the first one of the boot holding portions 23, it can be easily inserted over the entire surface of the gap Sa by stretching the boot 70 with the first one as a support.

Subsequently, an upper portion of the boot 70 is inserted into an annular groove 71*a* of the coupling 71 and thus assembling is terminated.

Subsequently, an explanation will be given to operation of the above constitution. FIGS. 1 and 2 show a state, in which the monolever 61 is not inclined but centrally positioned in a neutral position Mn, in which any hydraulic pressure is not generated from the hydraulic pressure generating means Hd. Suppose, for example, that the monolever 61 is operated to be inclined to a maximum position Mm in the right and left direction as shown in FIG. 1. Accompanying this inclination, the disk plate 64 mounted on the monolever 61 is inclined to abut against the peak Pa of the semi-circular projection of the lever bearing portion 21 to be stopped, while pushing the piston 62*b*.

At this time, the lever bearing portion 21 is subjected to a bending force from the disk plate 64 but the lever bearing portions 21 are formed to be arcuate to be made high in allowable bending stress and so can be made thin as compared with the prior art. When the monolever 61 is turned at a maximum inclination θm, the piston 62*b* is pushed to the maximum and the hydraulic pressure generating means Hd generates a maximum hydraulic pressure corresponding to a maximum displacement.

Whenever the monolever 61 is operated at the maximum inclination θm in the above manner, the disk plate 64 abuts against the peak Pa of the semi-circular projection of the lever bearing portion 21. Since the monolever bearing member 17 is subjected to heat treatment to be increased in hardness and enhanced in abrasion resistance, it is susceptible of less wear, which eliminates a change in the maximum inclination even after use over a long term. Thereby, there is caused no change in maximum running speed, turning speed and the like, and operability experiences no change from the first to make operation easy in the same manner as at the time of shipping.

While the above explanation has been given to the right and left direction, the same results can be obtained with respect to the front and rear direction. Also, while an explanation has been given to the above embodiment, in which the pistons 62*a*, 62*b*, 62*c*, 62*d* are arranged on perpendicular lines in the X-axis direction (for example, a right and left direction) and the Y-axis direction (for example, a front and rear direction), another embodiment may be adopted, in which the pistons 62*a*, 62*b*, 62*c*, 62*d* are arranged to be offset 45 degrees from the perpendicular lines in the X-axis direction and the Y-axis direction. Also, while an explanation has been given to the above embodiment by way of the hydraulic monolever operating device 1, the above arrangement can be used in an electrical type operating lever device, in which a single operating lever is operatively inclined to have each of four pistons issuing an electric signal representative of its displacement, as in Japanese Patent Laid-Open No. 89515/1997.

What is claimed is:

1. A monolever operating device comprising:

a monolever capable of inclining in a two-dimensional optional direction conformed to at least a front and rear direction and a right and left direction;

drive signal generating means received in a drive signal generating body to output two drive signals to components in the front and rear direction and in the right and left direction in accordance with an orientation and an amount of inclination of the monolever;

a universal joint mounted on the drive signal generating body to support the monolever in an inclinable manner;

a mount plate for mounting the drive signal generating body mounted thereto to a vehicle body;

a boot provided between the monolever and the mount plate to cover the drive signal generating means; and a monolever bearing member provided on an upper surface of the mount plate and provided with lever bearing portions and boot holding portions alternately arranged adjacent to each other in a circumferential direction, such that the lever bearing portions are not co-located with the boot holding portions.

2. The monolever operating device according to claim 1, wherein the monolever bearing member comprises a press formed part of a low-carbon steel material subjected to carburization.

3. The monolever operating device according to claim 2, wherein the monolever bearing member comprises lever bearing portions provided perpendicular to a surface thereof being mounted on the mount plate and boot holding portions provided in parallel to the surface to hold the boot.

4. The monolever operating device according to claim 2, wherein slits are provided between the lever bearing portions and the boot holding portions of the monolever bearing member.

5. The monolever operating device according to claim 2, wherein the lever bearing portions of the monolever bearing member are formed to the arcuate as viewed in plan view.

6. The monolever operating device according to claim 1, wherein the monolever bearing member comprises lever bearing portions provided perpendicular to a surface thereof being mounted on the mount plate and boot holding portions provided in parallel to the surface to hold the boot.

7. The monolever operating device according to claim 6, wherein slits are provided between the lever bearing portions and the boot holding portions of the monolever bearing member.

8. The monolever operating device according to claim 4, wherein the lever bearing portions of the monolever bearing member are formed to be arcuate as viewed in plan view.

9. The monolever operating device according to claim 7, wherein the lever bearing portions of the monolever bearing member are formed to be arcuate as viewed in plan view.

10. The monolever operating device according to claim 6, wherein the lever bearing portions of the monolever bearing member are formed to be arcuate as viewed in plan view.

11. The monolever operating device according to claim 1, wherein slits are provided between the lever bearing portions and the boot holding portions of the monolever bearing member.

12. The monolever operating device according to claim 1, wherein the lever bearing portions of the monolever bearing member are formed to be arcuate as viewed in plan view.

13. A control lever device for outputting one or more drive signals in accordance with an orientation and amount of inclination of a lever, comprising:

a mount plate for mounting the control lever device to a vehicle body; and a lever bearing member having one or more lever bearing portions for stopping the lever and positioned on the lever bearing member in locations where the lever will activate the drive signals and the level bearing member will stop the inclination of the lever, the lever bearing member being coupled to at least one surface of the mount plate, the lever bearing member further having boot holding portions, wherein the lever bearing portions and the boot holding portions are alternately arranged adjacent to each other in a circumferential direction such that the one or more lever bearing portions are not co-located with the boot holding portions.

14. The control lever device of claim 13, wherein at least the one or more lever bearing portions are formed of a low-carbon steel material previously subjected to carburization.

15. The control lever device of claim 14, wherein the lever bearing member further having boot holding portions, the boot holding portions and the lever bearing portions are alternately arranged adjacent to each other in a circumferential direction, and wherein the lever bearing member is press formed.

16. The control lever device of claim 15, wherein slits are provided between the lever bearing portions and the boot holding portions.

17. The control lever device of claim 16, wherein lever bearing portions are perpendicular to a surface of the lever bearing member and the boot holding portions are parallel to the surface of the lever bearing member to hold a boot.

18. The control lever device of claim 13, wherein slits are provided between the lever bearing portions and the boot holding portions.

19. A control lever device for outputting one or more drive signals to components in accordance with an orientation and amount of inclination of a lever, comprising:

a drive signal generating body including a drive signal generating means that outputs two drive signals, the drive signal generating body further including a mount plate for mounting to a vehicle body; and a lever bearing member having lever bearing portions and boot holding portions alternatively arranged adjacent to each other in a circumferential direction such that the lever bearing portions are not co-located with the boot holding portions, the lever bearing member being a separate piece that is positioned and mounted on an upper surface of the mount plate so that the lever bearing portions stop the amount of inclination of the lever, wherein at least the lever bearing portions are formed durable from carburization so that the lever will not damage the drive signal generating body during operation and will operate properly throughout extensive repetitive use of the control lever device.

* * * * *